US010927656B2

(12) United States Patent
Goksel

(10) Patent No.: US 10,927,656 B2
(45) Date of Patent: Feb. 23, 2021

(54) SYSTEM AND A METHOD FOR EXPLOITATION OF GAS FROM GAS HYDRATE FORMATIONS

(71) Applicant: Osman Zuhtu Goksel, Ankara (TR)

(72) Inventor: Osman Zuhtu Goksel, Ankara (TR)

( * ) Notice: Subject to any disclaimer, the term of this patent is extended or adjusted under 35 U.S.C. 154(b) by 442 days.

(21) Appl. No.: 15/551,350

(22) PCT Filed: Feb. 12, 2016

(86) PCT No.: PCT/TR2016/050037
§ 371 (c)(1),
(2) Date: Aug. 16, 2017

(87) PCT Pub. No.: WO2016/133480
PCT Pub. Date: Aug. 25, 2016

(65) Prior Publication Data

US 2018/0045029 A1 Feb. 15, 2018

(30) Foreign Application Priority Data

Feb. 16, 2015 (WO) ..... PCT/TR2015/000051

(51) Int. Cl.
*E21B 43/38* (2006.01)
*E21B 43/30* (2006.01)
(Continued)

(52) U.S. Cl.
CPC ..... *E21B 43/38* (2013.01); *E21B 7/04* (2013.01); *E21B 29/06* (2013.01); *E21B 43/086* (2013.01);
(Continued)

(58) Field of Classification Search
CPC ..... E21B 2043/0115; E21B 29/06; E21B 43/086; E21B 43/16; E21B 43/28;
(Continued)

(56) References Cited

U.S. PATENT DOCUMENTS 2,401,035 A * 5/1946 Akeyson ..... E21B 43/082 166/205
6,561,732 B1 * 5/2003 Bloomfield ..... E02B 11/005 138/125
(Continued)

FOREIGN PATENT DOCUMENTS

CN 1587642 A 3/2005
CN 1944950 A 4/2007
(Continued)

*Primary Examiner* — Christopher J Sebesta
(74) *Attorney, Agent, or Firm* — Bayramoglu Law Offices LLC

(57) ABSTRACT

The invention is related to a system which has been developed to obtain gas from the gas hydrate formations that are found under the frozen layers of earth in the cold regions or sea floor/slopes and comprises a drilling machine (3) that performs drilling by means of a drilling bit (33) after being lowered into the drilled well, drilling machine lowering and controlling equipment (1) which allow said drilling machine (3) to be lowered into the well and supply power and control to the system (A), and a stripped production tubing (4) with plugs (41) in which the water level and water level dependent pressure and gas pressure are controlled, which allows for the dissociation of the formation into gas and water and forming a cavern (6), and in which the gas separated from the gas hydrate formation reaches the surface; and to the method presented by using said system (A).

9 Claims, 7 Drawing Sheets

(51) Int. Cl.

| | |
|---|---|
| ***E21B 43/08*** | (2006.01) |
| ***E21B 43/28*** | (2006.01) |
| ***E21B 29/06*** | (2006.01) |
| ***E21B 7/04*** | (2006.01) |
| ***E21B 43/16*** | (2006.01) |
| *E21B 41/00* | (2006.01) |
| *E21B 7/18* | (2006.01) |
| *E21B 47/09* | (2012.01) |

(52) U.S. Cl.
CPC ..... *E21B 43/16* (2013.01); *E21B 43/28* (2013.01); *E21B 43/30* (2013.01); *E21B 7/18* (2013.01); *E21B 41/0099* (2020.05); *E21B 47/09* (2013.01)

(58) Field of Classification Search
CPC ..... E21B 43/30; E21B 43/38; E21B 47/09; E21B 7/04; E21B 7/18; E21B 43/18; E21B 43/24; E21B 41/0099
See application file for complete search history.

(56) References Cited

U.S. PATENT DOCUMENTS

| | | | | |
|---|---|---|---|---|
| 2007/0107901 | A1* | 5/2007 | Maguire | F24T 10/20 166/302 |
| 2007/0144738 | A1* | 6/2007 | Sugiyama | E21B 43/119 166/250.07 |
| 2008/0115971 | A1* | 5/2008 | Kelleher | E21B 21/001 175/5 |
| 2009/0236144 | A1* | 9/2009 | Todd | E21B 17/01 175/5 |
| 2011/0240282 | A1* | 10/2011 | Telfer | E21B 29/06 166/117.5 |
| 2012/0097401 | A1* | 4/2012 | Hester | E21B 41/0064 166/369 |
| 2012/0325555 | A1 | 12/2012 | Jette et al. | |
| 2014/0305709 | A1* | 10/2014 | Slaughter, Jr. | E21B 7/062 175/76 |
| 2015/0184806 | A1* | 7/2015 | Beg | F16L 55/02718 137/12 |

FOREIGN PATENT DOCUMENTS

| | | | |
|---|---|---|---|
| CN | 102322245 | A | 1/2012 |
| JP | 2005029984 | A | 2/2005 |
| RU | 2026999 | C1 | 1/1995 |
| WO | 2004009958 | A1 | 1/2004 |
| WO | 2012011994 | A1 | 1/2012 |

* cited by examiner

SYSTEM AND A METHOD FOR EXPLOITATION OF GAS FROM GAS HYDRATE FORMATIONS

TECHNICAL FIELD

The invention is related to a system and a method developed to obtain gas from gas hydrate formations.

The invention is particularly related to a production tubing. The production tubing is drilled in the form of strips beforehand wherein the openings drilled in the form of strips are plugged and sealed with pressure resistant plugs. Said production tubing is used in a system which is developed to obtain gas from gas hydrate formations. Said production tubing can also can be used in the production of petroleum, petroleum liquids, gas, shale gas, and all kinds of hydrocarbons.

STATE OF THE ART

A gas hydrate is a crystalline solid that consists of a gas molecule surrounded by water molecules. Gas hydrates may be formed of a number of gases with a proper molecular size. These include carbon dioxide, hydrogen sulfide and several low carbon number hydrocarbons, including methane. Gas hydrate also called methane hydrate or methane clathrate.

The nominal gas hydrate composition is 1 mole of methane for every 5.75 moles of water, corresponding to 13.4% methane by mass, although the actual composition is dependent on how many methane molecules fit into the various cage structures of the water lattice. The observed density is around 0.9 g/cm$^3$, which means that gas hydrate will float to the surface of water. One litre of fully saturated gas hydrate solid would therefore contain about 120 grams of methane (or around 169 litres of methane gas at 0° C. and 1 atm).

Hydrates tend to form in the pore spaces of sediment layers, as well as nodules or deposits of pure hydrate. Gas hydrates are stable under the conditions of low temperature and high pressure. They are typically found on the sea floor after certain depths around 1200 meters and 1500 meters below sea level and under the permafrost layer after certain depths around 200 meters and 1100 meters below ground level. It is also called Gas Hydrate Stability Zone or Gas Hydrate Formation.

When using gas hydrate as an energy source, it is necessary to dissociate gas hydrate to methane gas and water and collect the methane gas.

Gas hydrate bearing layers are subject to be pressurized by overburden weight of the formation or combined overburden weight of seawater and the formation. Gas hydrate dissociates into methane gas and water when depressurized. Dissociation of the gas hydrate requires decreasing gas hydrate's pressure or increasing gas hydrate's temperature or both. Dissociation pressure is required pressure for gas hydrate dissolves. Various parameters effect dissociation pressure including gas hydrate temperature, gas composition, presence of acid gases, gas content and others.

Care must be taken during dissociation because of the potential for phase transition from the solid hydrate to release water and methane gas at a high rate when the pressure is reduced. The rapid release of methane gas in a closed system can result in a rapid increase in pressure.

In some of the current applications, dissociation of the gas hydrate formation is provided by depressurization. Pressure is reduced by decreasing water level in the well or completely removing the water from well. In doing so, the gas hydrate formation is exposed to low pressure and dissociate to gas and water and thus gas is produced by reaching the surface.

As pressure in the well is reduced, low pressure causes formation to dissociate and release methane gas. Dissociated water moves into well. Subsequent removal of water and gas causes a region of low pressure again effecting adjacent portion of the well and causing further dissociation and gas production. But low pressure effects just adjacent portion of the well and cannot be spread through the deep inside the gas hydrate formation. Therefore dissociation of the formation remains limited which in turn causes the amount of the produced gas to be limited. Another complication is that hydrate dissociation is an endothermic process which is a process that uses heat. So, a natural consequence of dissociation is cooling and potential re-freezing of adjacent portions of the reservoir.

Gas hydrate inhibition is another method proposed for introducing gas hydrate dissociation using chemicals to destabilize gas hydrate. However, excessive use of chemicals has potential to harm the environment and may be expensive.

One of application relevant to the subject is 2012325555. This application is about a tunneling system. The subsurface drilling system is a robotic system which consists of a surface power controller, umbilical tether, robotic tender and auxiliary units. The robotic drilling system creates a hole at the front end and passes the cuttings to the back of the robot and thus the hole keeps advancing continuously.

Said robotic system moves inside the hole it has created. The system needs to secure itself inside the hole in a stabilized manner for the advancing and cutting movements of the robot. However, the walls of the tunnel cannot remain stabilized and the robot cannot secure itself due to the fact that the hole expands as a result of the dissociation of gas hydrate into gas and water, thereby creating a larger size tunnel filled with gas and water. Therefore, this application cannot be used for obtaining gas from the gas hydrate formations.

Yet another application relevant to the subject is RU2026999C1.

According to this application gas is converted from hydrate into free gas by increasing the temperature which brings the pressure at the increased temperature below the dissociating pressure." Application details its methodology that ". . .. Hot water feed inside the tubing string, then flows out of its holes to heat up the drilling shot, and also flows into the hollow working elements and out through its perforations to heat up the rocks of the seam of hydrates. The ball closes of the package in the packer, and hot water under pressure fully heats up the drilling shot and rocks." It is also expressed in the application that hot water penetrates into formation under pressure to increase the temperature.

But utilization of higher pressure, which needs to be higher than formation pressure for penetration of hot water into formation, may result in higher temperature requirement for dissociation. In other worlds, increase in the formation pressure, requires higher temperature for dissociation. Higher temperature may be provided by more hot water penetrating into formation. But more hot water penetration into formation requires more higher hot water pressure again. So application of the methodology may become a kind of cycle where industrial application may be questionable.

On the other hand the methodology is applied in cycles, a heating cycle followed by a gas production cycle. When gas hydrate dissociates, almost 80% of the dissociated volume becomes water and remains in the well which fills into lower levels of the dissociated formation. During following cycle, hot water mixes with dissociated water and cools down. Penetration of the hot water into formation during following cycle becomes less effective in the presence of the dissociated water from previous cycle. Considering the amount of total dissociated water increases at each cycle, inevitably, temperature of the mixed hot water becomes lower than temperature of the mixed hot water used during previous cycles.

One may say that efficiency of the methodology decreases at each cycle and after a number of cycles temperature of the hot water may not enough for bringing the pressure at the increased temperature below the dissociating pressure.

In conclusion, due to the above mentioned drawbacks and inadequacy of the existing solutions with respect to the subject matter, it is deemed necessary to make a development in the relevant technical field.

According to this application sealing members used to provide sealing between Heat Transfer Perforated Member (HTPM) numbered (8) and string (1). Sealing of the HTPM (8) from formation during dissociation is an important part of the application. Otherwise free gas can accumulate which leads to kick in pressure and explosion according to the application, Thus material of the sealing (11) is expected to provide sealing and expected to remain non-disintegrated (despite deformation of its integrity when HTPM (8) is driven by a percussion mechanism) and elastic enough under high temperature and pressure to provide sealing between string (1) and HTPM (8). One may expect that this is a difficult task.

OBJECT OF THE INVENTION

The present invention relates to a system and a method for obtaining gas from gas hydrate formations meeting the above mentioned requirements, eliminating all the disadvantages and introducing some additional advantages.

The primary object of the invention is to allow for obtaining gas from the gas hydrate formations which can be used as a fuel. Thus, it is possible to use the gas obtained from gas hydrate formations as an energy source in various areas.

Another object of the invention is depresuration of stripped production tubing of the invention and spreading low pressure inside the gas hydrate formation through holes drilled into formation. Thereby, the invention aims maximizing the diffusion of the low pressure into formation as low pressure causes the formation to dissociate and release methane gas.

Another object of the invention is forming a cavern in the formation around drilled holes. Thereby, the invention aims to provide an effective dissociated water management and benefit from dissociated water pool in the cavern.

Yet another object of the invention is to form holes on the production tubing of the invention and then to plugged and to sealed with a pressure resistant material which can be drilled and ripped by means of drill bit. Thereby, the invention aims to maximize the amount of the gas to be obtained from the entire formation by starting the gas production from the lower elevations to upper elevations in the gas hydrate formations, level-by-level.

Another object of the invention is to avoid excessive use of chemicals during gas production.

In order to fulfill the abovementioned objects; the invention is a system which has been developed to obtain gas from the gas hydrate formations, comprises a drilling machine that performs drilling by means of a drilling bit after being lowered into the drilled well, a drilling machine lowering and controlling equipment which allows said drilling machine to be lowered into the well, supplies power to the system and controls the same and a production tubing with plugs that covers the opening drilled in the form of strip beforehand on said stripped production tubing.

In order to achieve the objects of the invention a method is developed which comprises process steps, drilling a well containing gas hydrate formations, placing a stripped production tubing with plugs alongside the gas hydrate formation into the drilled well, selecting a lower elevation of the gas hydrate formation as targeted level, removing water from the well providing depressurization of the stripped production tubing, bringing a drilling machine to the targeted level of the gas hydrate formation through the stripped production tubing by means of a drilling machine lowering and controlling equipment, drilling plugs on the stripped production tubing at the targeted level of the gas hydrate formation by means of drilling bit of said drilling machine, drilling holes into the gas hydrate formation by means of the drilling bit and allowing for dissociation of the formation to gas and water with diffusing low pressure into the formation through drilled holes, controlling water level and water pressure inside the stripped production tubing and the amount of the produced gas from wellhead to maintain a low pressure at the targeted level while dissociated gas and water is being replaced with a cavern, drawing said drilling bit back into the stripped production tubing, repeating the process steps at each level, starting from lower level to upper level of the gas hydrate formation, obtaining the separated gas from the wellhead.

All structural and characteristic features and all the advantages of the invention will be more clearly understood thanks to the following FIGURES and detailed description composed with reference to these FIGURES and for this reason, it is necessary that the evaluation be done by taking into consideration these FIGURES and detailed description.

FIGURES FACILITATING THE UNDERSTANDING OF THE INVENTION

Figure 12:
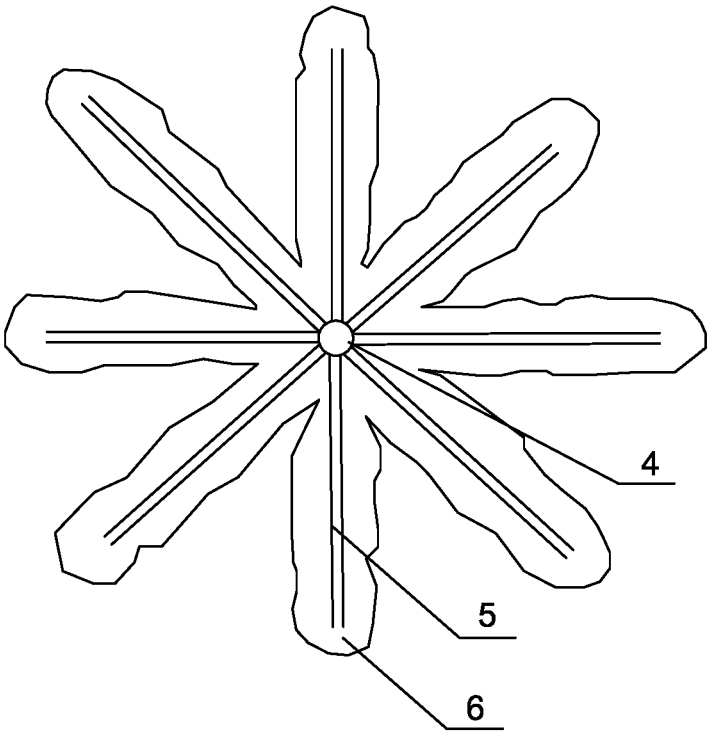
FIG. 12 represents an upper plan view of holes drilled into formation at targeted level. Later holes expand and create void spaces, initiating a cavern which is also shown in the FIGURE.
Figure 13:
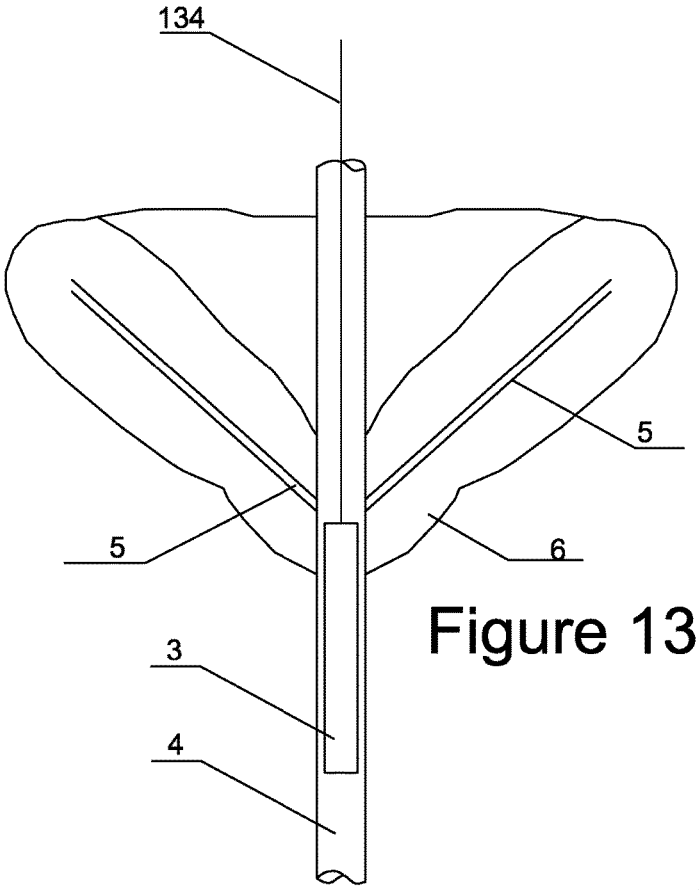

FIG. 13 represents a view of holes drilled into formation at targeted level. Later cavern is formed. Cavern is also shown in the FIGURE for explonatary purposes, like above FIG. 12.

Figure 14:
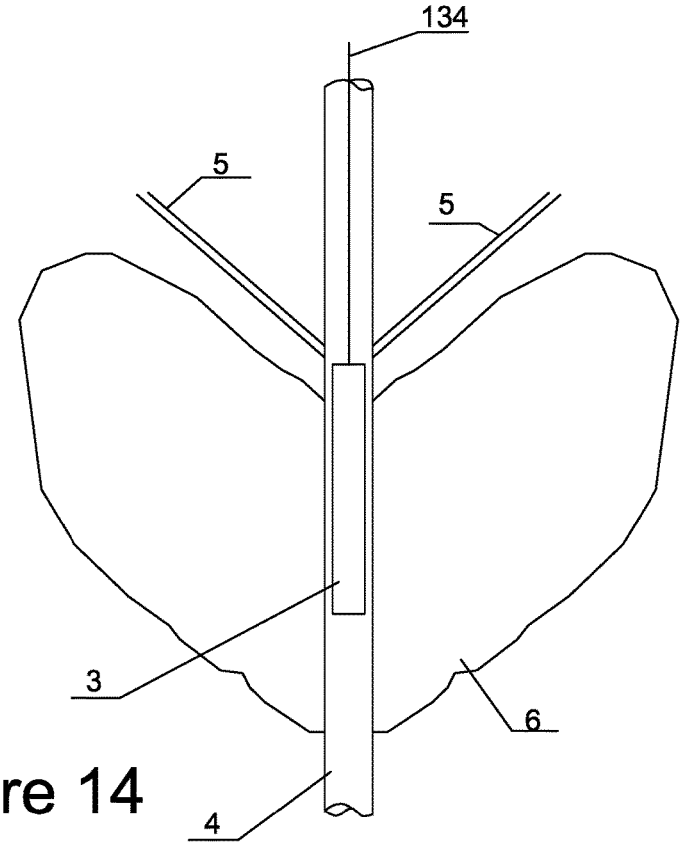

FIG. 14 represents a view of holes drilled into formation at upper level and cavern expanded upwards.

The drawings do not need to be scaled necessarily and the details that are not necessary for the representation of the present invention may have been ignored. Apart from this, the elements that are at least substantially identical or that have at least substantially identical functions are shown with the same numbers.

DESCRIPTION OF PART REFERENCES

A. System

1. Drilling machine lowering and controlling equipment
- 11. Pressure container
- 12. Drilling machine loading pipe
- 13. Sealing element
  - 131. Pressure chamber
  - 132. Pressure sensor
  - 133. Sealing gasket
  - 134. Carrying cable
- 14. Cable roller
- 15. Cable carrying pipe
- 16. Cable cutter
- 17. Power and control equipment

2. Production tubing

3. Drilling machine
- 31. Stabilizer legs
  - 311. Stabilizer leg shoe
  - 312. Stabilizer leg springs
- 32. Fixing legs
  - 321. Electromagnetic leg shoe
  - 322. Fixing leg springs
- 33. Drilling bit
  - 331. Drilling bit casing
  - 332. Guiding roller
- 34. Drilling machine body
- 35. Slide
  - 351. Slide forwarding shaft
  - 352. Slide shaft
- 36. Drill chuck
  - 361. Drill chuck rotating shaft
  - 362. Drill chuck bearing
- 37. Sensor
- 38. Plug removal tool

4. Stripped production tubing
- 41. Plug

5. Hole

6. Cavern

DETAILED DESCRIPTION OF THE INVENTION

In this detailed description, the preferred embodiments of the system and method developed to obtain gas from gas hydrate formations according to the invention are described only for a better understanding of the subject without any limiting effects.

Figure 1:
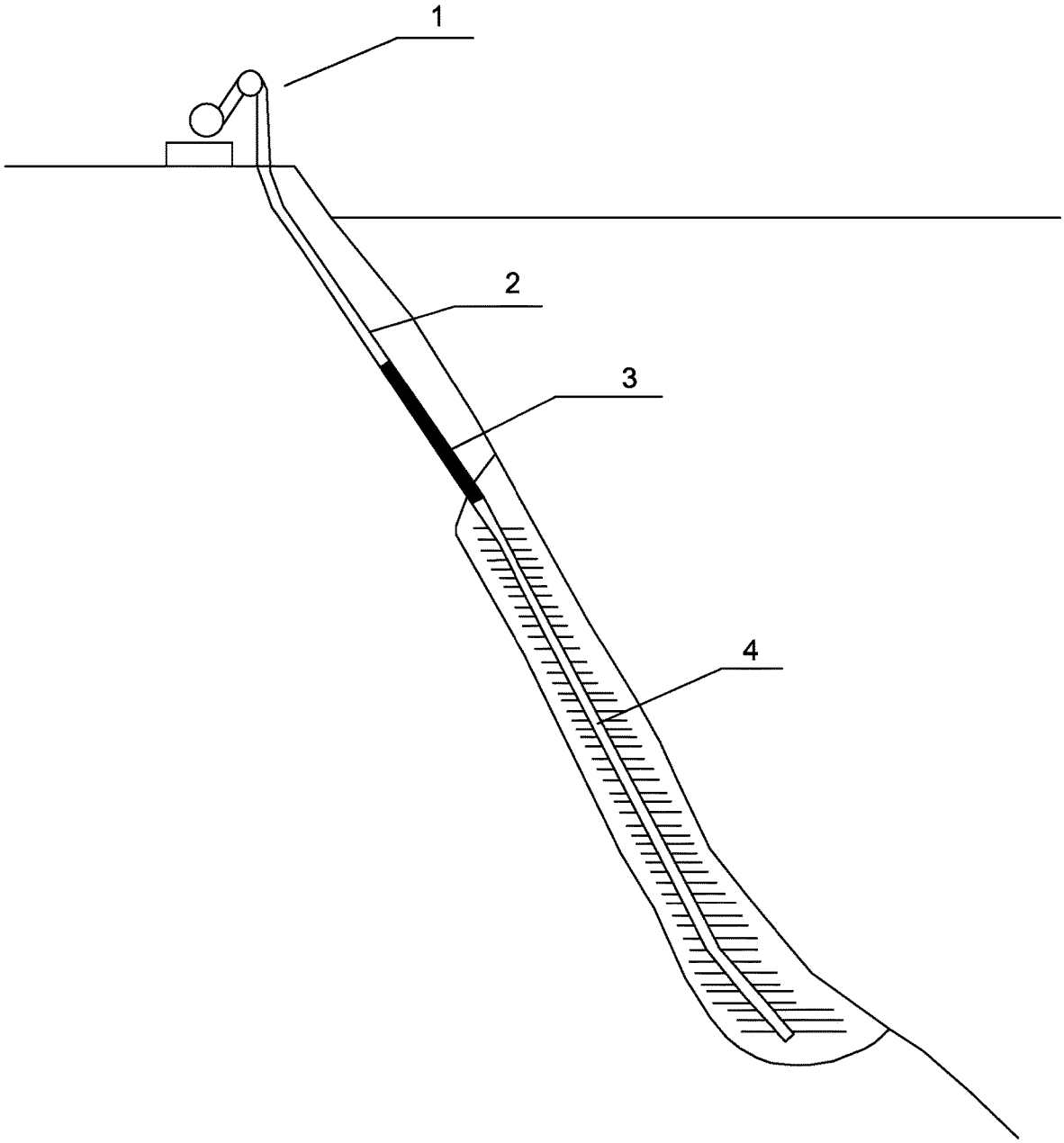
FIG. 1 represents a general view of the system that allows for obtaining gas from gas hydrate formations.

FIG. 1 represents a general view of the system (A) that can be used in the production of all kinds of hydrocarbons from gas hydrate formations which are exist under frozen layers of earth (permafrost) in the cold regions or sea floor or slopes. As seen in the FIGURE, the main components of the system (A) are as follows: a drilling machine lowering and controlling equipment (1), a production tubing (2), a drilling machine (3), and a stripped production tubing (4) which is used preferably only along the gas hydrate formation. Said production tubing (2) is the same as the production tubing used in the prior art.

Figure 2:
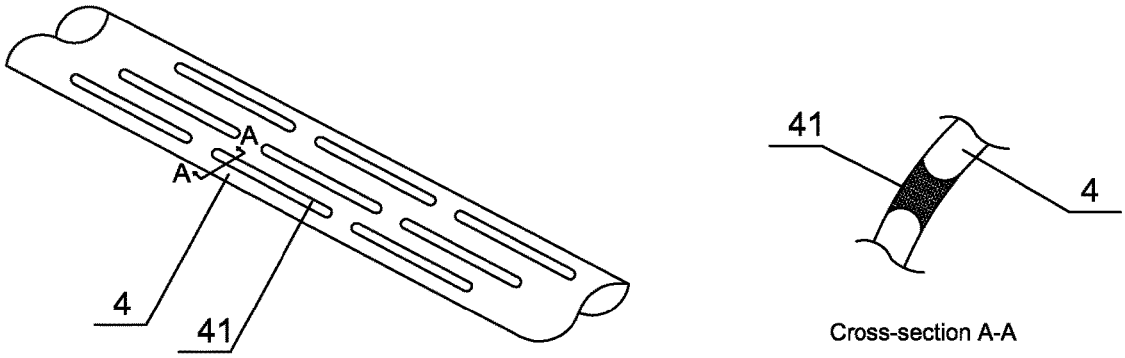
FIG. 2 represents a view of the production tubing which is drilled in the form of strips beforehand and on which the drilled openings in the form of strips are covered with a pressure resistant material.

FIG. 2 represents a view of the stripped production tubing (4) which is drilled in the form of strips beforehand and filled with a pressure resistant material which can be easily drilled by means of a drilling bit (33) of the drilling machine (3). These filled areas on said stripped production tubing (4) are referred to as plug (41) within the description. Said plug (41) has a different color from the stripped production tubing (4) color so that plug (41) is detected by means of the sensor (37).

In order to drill multiple holes (5) into the gas hydrate formation starting from the lower levels to the upper levels, the drilling bit (33) of the drilling machine (3) needs to reach the formation easily from the inside of the stripped production tubing (4) with plugs (41) to formation. So, stripped production tubing (4) is drilled in the form of strips along the body beforehand. And in order to have only targeted level effected from depressurization, the holes (5) at the upper levels need to remain covered and sealed.

For that reason, said strips are filled with a pressure resistant material and sealed and that can be drilled and ripped easily by means of the drilling bit (33), thereby becoming a plug (41). The material of said plug (41) can be a micaceous organic or composite material that is pressure resistant and sealed and that can be drilled and ripped easily. Preferably, a wooden material can be used which is pressure resistant and sealed and can be drilled and ripped easily.

The well profiles may be sloped depending on the shape of the gas hydrate formation. Accordingly, the stripped production tubing (4) may need to be bent depending on the well profile; that is to say, the plug (41) needs to change shape together with the stripped production tubing (4). On the other hand, the plug (41) may be exposed to different pressures depending on different well depths and well shapes may be different and thus the material of the plug (41) may vary. Wooden or micaceous organic or composite materials can be used as the material of the plug (41) based on the well shape and pressure. For instance, using wooden material can be an adequate and economical solution for the plugs (41) in less sloped wells. However, if said stripped production tubing (4) needs to be bent from vertical position to horizontal position with a certain radius, it may be required to use a flexible material even though it may cost higher. Considering plug (41) material is also expected to be easily drilled and ripped by drilling bit (33), alternatively a plug removal tool (38) is attached on the drilling machine (3) for removal of the plug (41) so that cheaper plug (41) material is preferred and plug (41) is removed by plug removal tool (38) rather than drilling bit (33).

If strips on the stripped production tubing (4) are not sealed, depressurization of the stripped production tubing (4) causes upper levels are also exposed to low pressure and start dissociation around the stripped production tubing (4) together with targeted level. Such uncontrolled dissociation needs to be avoided. This shall be further clarified later.

Drilled strips along the body of the stripped production tubing (4) are equally spaced circumferentially. The width of the each strip is wide enough for drilling bit (33) passing through. The width of the strip is wider than the drilling bit width by taking into consideration the oscillation of the drilling bit (33).

The diameters of the stripped production tubing (4) may vary. Therefore, the number of strips drilled all around may vary depending on the diameter of the stripped production tubing (4).

The drilled strips have a length such that bended drilling bit (33) enters into the formation after passing (drilling) through the plug (41) without contacting with the stripped production tubing (4).

The strips may be drilled in a staggered way or in parallel to each other along the stripped production tubing (4).

Corners of the drilled strips are rounded so that the drilling bit (33) is prevented from contacting sharp corners and getting damaged. The rounded corners also help the plug (41) is better fastened into the drilled strip and sealed.

Figure 3:
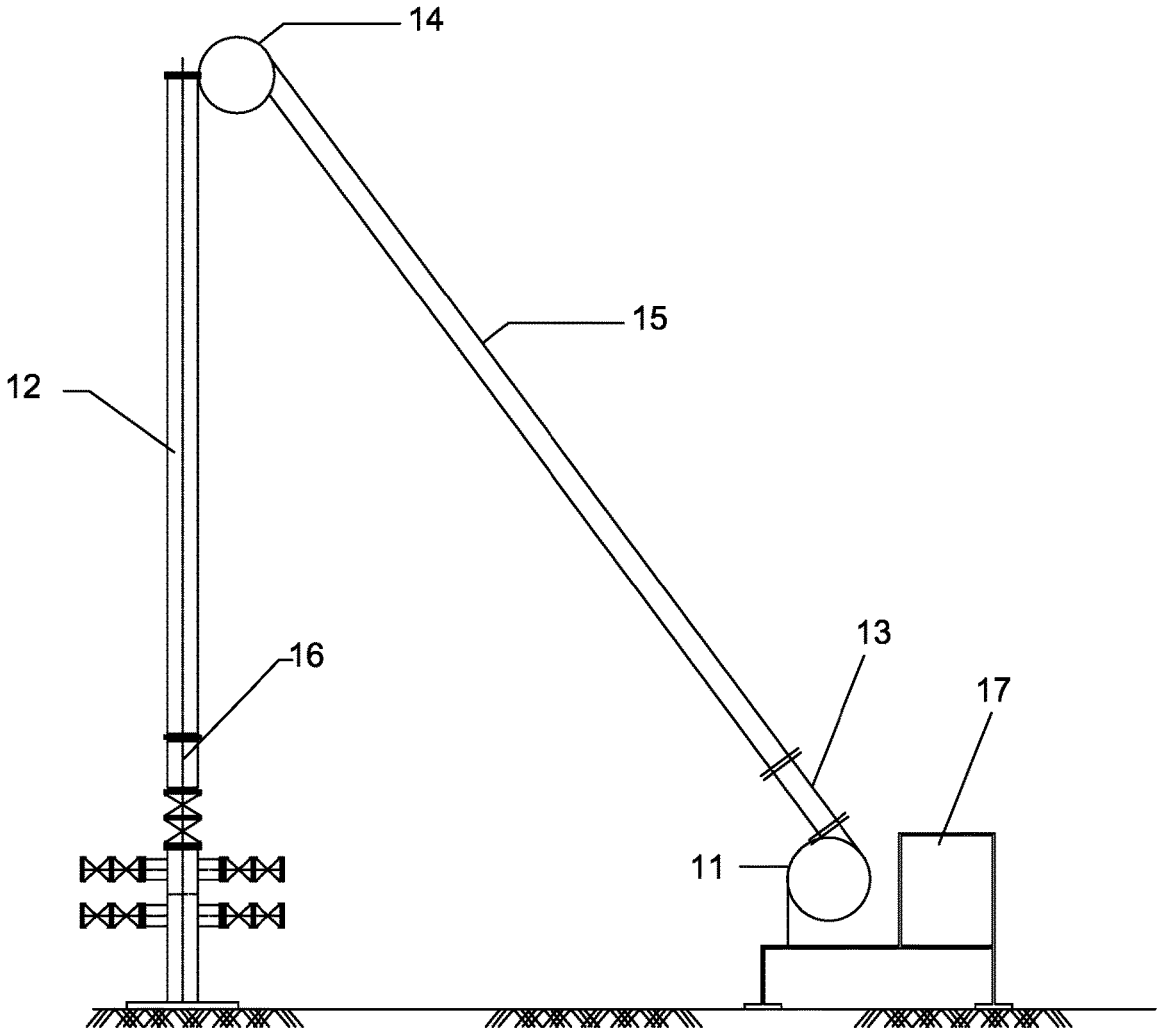
FIG. 3 represents a view of the wellhead drilling machine lowering and controlling equipment.

FIG. 3 represents a view of the drilling machine lowering and controlling equipment (1). The drilling machine lowering and controlling equipment (1) provides power and control required for lowering the drilling machine (3) into the well, drilling the plugs (41) and holes (5) into formation, allowing the drilling machine (3) to keep drilling the plugs (41) during gas production and pulling the drilling machine (3) out of the well.

First element of the drilling machine lowering and controlling equipment (1) is pressure container (11). The drums, on which the cables are stored, are located inside pressure container (11). The pressure container (11) is pressure bearing to internal pressure which is higher than wellhead pressure. During gas production, produced gas fills in the pressure container (11). Or alternatively pressure container (11) is filled with non-hazardous gases such as nitrogen or with water and pressurized up to the wellhead pressure.

The second element of the drilling machine lowering and controlling equipment (1) is drilling machine loading pipe (12). The drilling machine (3) is located inside the drilling machine loading pipe (12) before being lowered into the well. Length of the drilling machine loading pipe (12) is more than total length of the drilling machine (3); therefore, the drilling machine (3) can be isolated inside the drilling machine loading pipe (12). Even when the well is under pressure, the drilling machine loading pipe (12) enables lowering the drilling machine (3) into the well or to pulling the same out of the well. The drilling machine loading pipe (12) is pressure bearing to internal pressure which is higher than wellhead pressure. During gas production, produced gas fills in the drilling machine loading pipe (12).

The third element of the drilling machine lowering and controlling equipment (1) is cable roller (14). All cables and hoses such as power cable, control cable, display cable, water hose, chemical injection hose and drilling machine carrying cable pass through the cable roller (14). The cable roller (14) transfers the cables and hoses from the drilling machine loading pipe (12) to the cable carrying pipe (15). The cable roller (14) is pressure bearing to internal pressure which is higher than wellhead pressure. During gas production, produced gas fills in the cable roller (14).

Cable carrying pipe (15) is the fourth element of the drilling machine lowering and controlling equipment (1). Said cable carrying pipe (15) is the one between the pressure container (11) and the cable roller (14). The cable carrying pipe (15) is pressure bearing to internal pressure which is higher than wellhead pressure. During gas production, produced gas fills in the cable carrying pipe (15).

The fifth element of the drilling machine lowering and controlling equipment (1) is cable cutter (16). If an emergency arises and it is required to shut down the wellhead valves and isolate the well immediately, even without waiting for drilling machine (3) is pulled back into drilling machine loading pipe (12) from well, cable cutter (16) cuts cables and hoses allowing these cables and hoses to fall into the well and enables wellhead valves isolating the well. The cable cutter (16) is located between the drilling machine loading pipe (12) and the wellhead. The cable cutter (16) is pressure bearing to internal pressure which is higher than wellhead pressure. During gas production, produced gas fills in the cable cutter (16).

The sixth element of said drilling machine lowering and controlling equipment (1) is power and control equipment (17). It provides required power and control for drilling machine (3) including surveillance, display and location determination required for operation of the drilling machine (3) and pressure control of the system (A).

Figure 4:
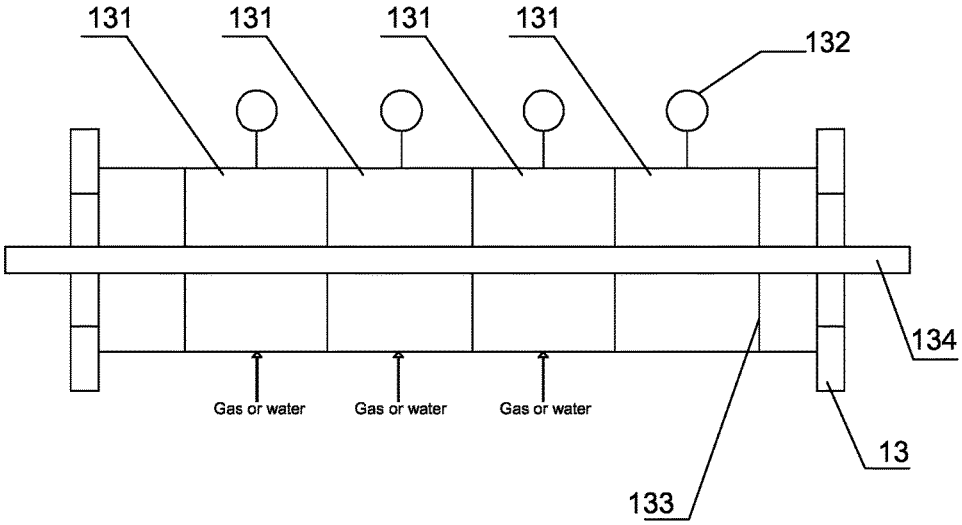
FIG. 4 represents a view of the sealing element which is one of the wellhead drilling machine lowering and controlling equipment.

FIG. 4 represents a view of the sealing element (13) which is seventh element of the drilling machine lowering and controlling equipment (1). The sealing element (13) prevents the produced gas entering into the pressure container (11) during the gas production if it is preferred to isolate pressure container (11) from produced gas.

The sealing element (13) consists of pressure chambers (131) arranged in stages. Each pressure chamber (131) is filled with a non-hazardous gas such as nitrogen or the like or with water and pressurized up to the wellhead pressure.

Pressure change at the wellhead, and thus the pressure difference occurring between the pressure container (11) and the wellhead is compensated by sealing element (13), until pressure in the pressure container (11) is equalized with the wellhead pressure. Pressure inside each pressure chamber (131) is individually measured by means of pressure sensor (132). Pressure difference is distributed equally among the pressure chambers (131) and pressure inside the each pressure chamber (131) is individually adjusted by injecting or draining non-hazardous gas or water into the pressure chamber (131). Thus, each sealing gasket (133) functions under comparatively smaller pressure differences in comparison with overall pressure difference. Said sealing gasket (133) is elastic.

There is a carrying cable (134) which is strong enough to carry the total weight of the cables and hoses and the drilling machine (3) itself. This carrying cable (134) passes through said sealing element (13).

In a preferred embodiment of the system (A), all of the cables and hoses are incorporated in a single hose however, the carrying cable (134) is the part which carries the all weight. In this manner, it is possible to simplify the sealing element (13) and cable drum arrangements.

Figure 5:
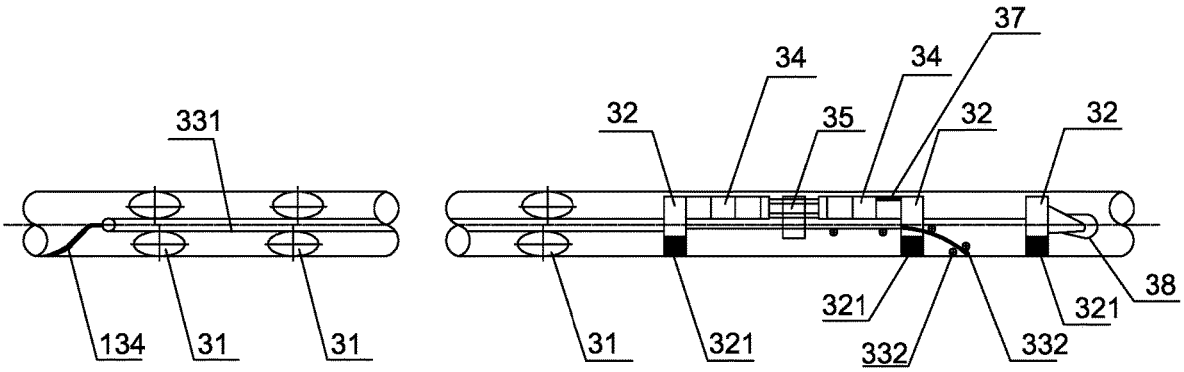
FIG. 5 represents a view of the drilling machine used for removal of plugs on the invention stripped production tubing and drilling holes into formation.

FIG. 5 represents a view of the drilling machine (3). Main components of the drilling machine (3) are drilling bit (33), drilling bit casing (331), stabilizer legs (31), fixing legs (32) and drilling machine body (34). A sensor (37) is also provided. The colored plug (41) is detected by means of the sensor (37) and the drilling bit (33) is positioned.

Drilling machine (3) secures itself inside the stripped production tubing (4) and drills the plugs (41) and holes (5) into the formation. The drilling machine (3) occupies partially the interior of the stripped production tubing (4) so that continuous gas and water pass are possible there between. Upward and downward movement of the drilling machine (3) inside the well is provided by self weight of the drilling machine (3) and the carrying cable (134).

The drilling bit (33) is the component which drills the plugs (41) and drills holes (5) into the formation. The diameters and characteristics of the drilling bit (33) can vary. Alternatively water jet is used for drilling. In this alternative, tip of the drilling bit has jet nozzles and drilling bit is hollow.

The drilling bit (33) is located inside the drilling bit casing (331). Water of water jet is heated and pressurized in the drilling bit casing (331), if water jet drilling is used. While drilling bit (33) is driven into formation, a pressure sensor measures water pressure of water jet inside the drilling bit casing (331) and forwarding speed of the drilling bit (33) is adjusted accordingly to minimize tear and wear of the drilling bit (33).

The plug removal tool (38) is attached to drilling machine (3). Plug removal tool (38) is a circular saw which is driven into the plug (41) for removal of the plug (41).

Figure 6:
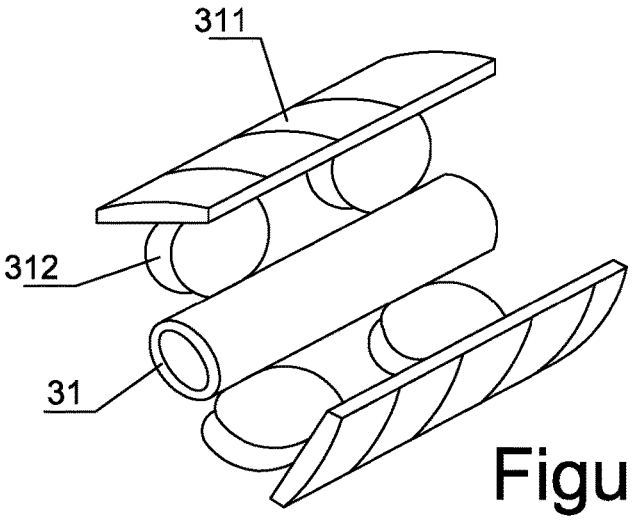
FIG. 6 represents a view of the stabilizer legs that allow the drilling bit casing to remain stable while the drilling machine is working.

FIG. 6 represents a view of the stabilizer legs (31) that allow for drilling bit casing (331) to remain stable during drilling. The stabilizer leg springs (312) connect the stabilizer leg shoe (311) to the body of the stabilizer leg (31).

Figure 7:
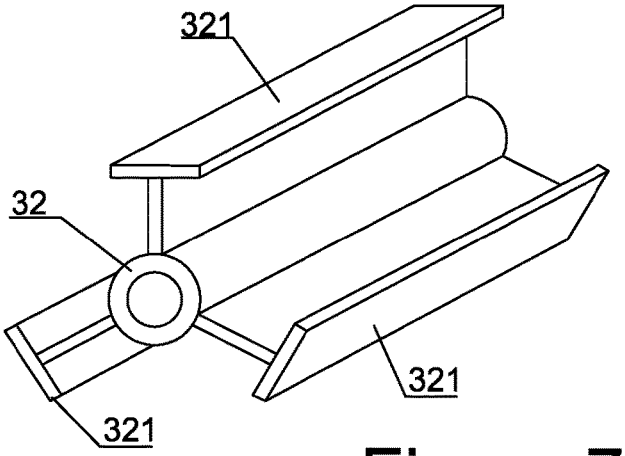
FIG. 7 represents a view of the fixing legs that allow for fixing the drilling machine.

FIG. 7 represents a view of the fixing legs (32) that allow for securing the drilling machine (3). The drilling machine (3) is secured inside the stripped production tubing (4) by means of the fixing legs (32). Preferably, the contact surface of the fixing legs (32) has electromagnetic leg shoes (321). When it is required to secure the drilling machine (3), the electromagnetic leg shoes (321) stick to the inner surface of the stripped production tubing (4) and secure the drilling machine (3).

Figure 8:
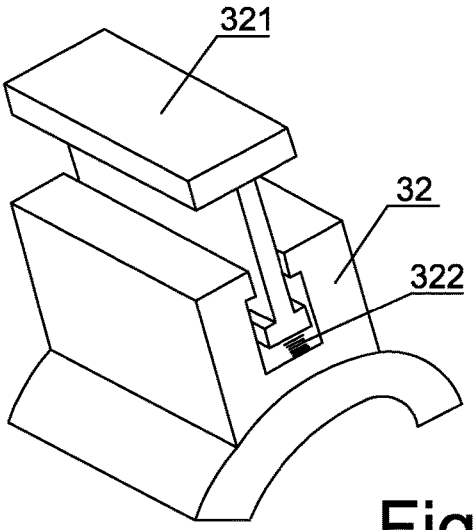
FIG. 8 represents a view of the shoes of the fixing legs which prevent the drilling machine from being obstructed while moving inside the pipe and also allow for fixing the same inside the pipe.

FIG. 8 represents a detailed view of the electromagnetic leg shoes (321). Fixing leg springs (322) are provided under the electromagnetic leg shoes (321). Said fixing leg springs (322) allows electromagnetic leg shoes (321) are pushed into the fixing legs (32) which allow the drilling machine (3) to move inside the stripped production tubing (4) without being obstructed.

Even when the upward and downward movement of the drilling machine (3) is restricted by means of the fixing legs (32), it may be required to rotate the drilling machine (3) around its own axis and to position the drilling bit (33) in relation to position of the plug (41). For this purpose at least one fixing leg (32) rotates around its own axis thus enables drilling machine (3) to rotate around its own axis after said drilling machine (3) is secured inside the stripped production tubing (4) at upward/downward direction. Once the drilling bit (33) is positioned, drilling machine (3) is fixed both in upward/downward and axial directions by using all fixing legs (32).

Figure 10:
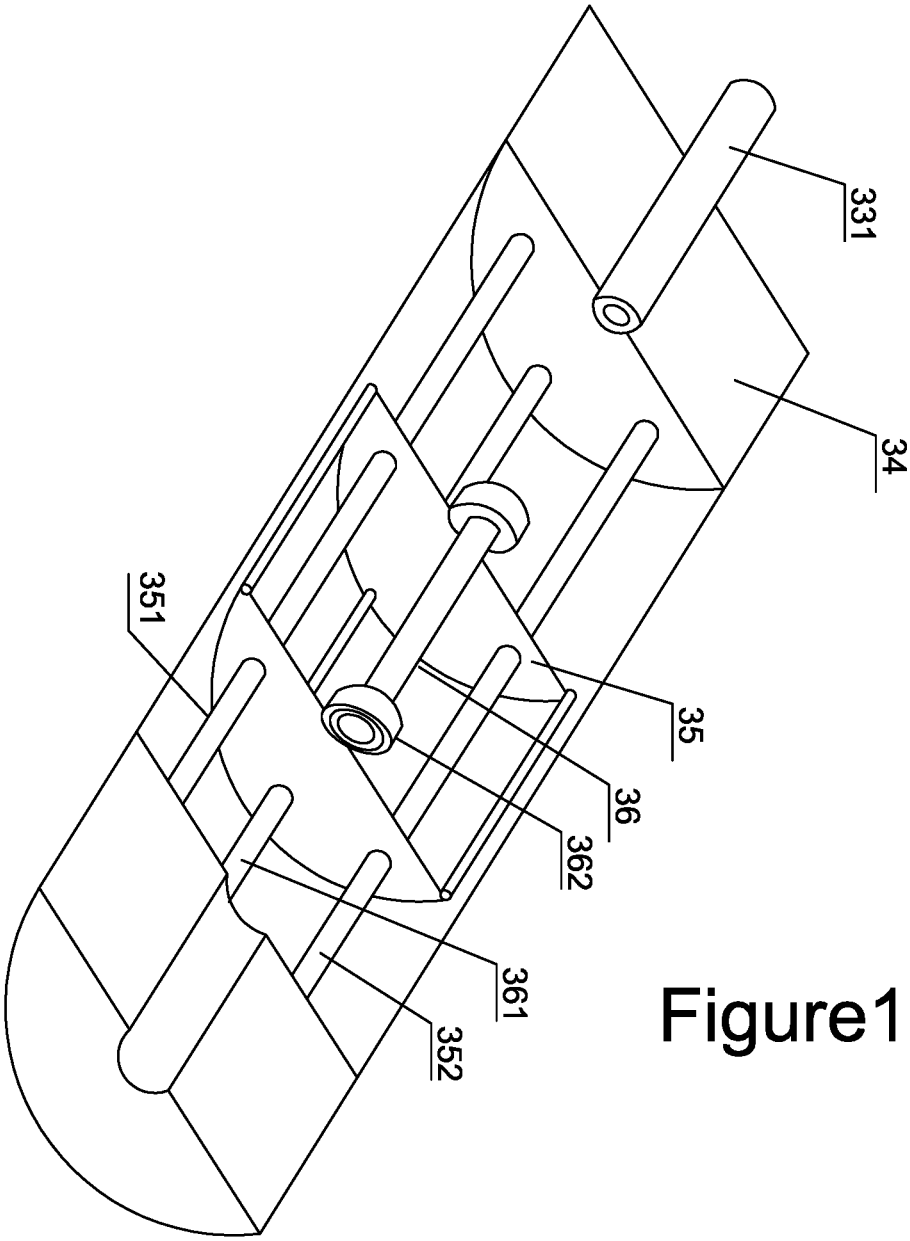
FIG. 10 represents a view of the drilling machine body.

FIG. 10 represents a cross section view of the drilling machine body (34). The drilling machine body (34) leaves enough space inside the stripped production tubing (4) for the gas and water to pass through. Motors are provided in the drilling machine body (34). Drill chuck rotating shaft (361) is driven by one of the motors. The drill chuck (36) is a component which holds the drilling bit (33) tightly or releases the same and preferably operates magnetically. The drilling bit (33) passes through the drill chuck (36). The magnetic drill chuck (36) is furnished with the drill chuck bearings (362) in order to provide rotational motion. The drill chuck (36) is driven by the drill chuck rotating shaft (361).

The slide forwarding shaft (351) is driven by another motor. The slide forwarding shaft (351) is the shaft which moves the drilling bit (33) forward or backward by moving the slide (35) forward and backward.

Figure 9:
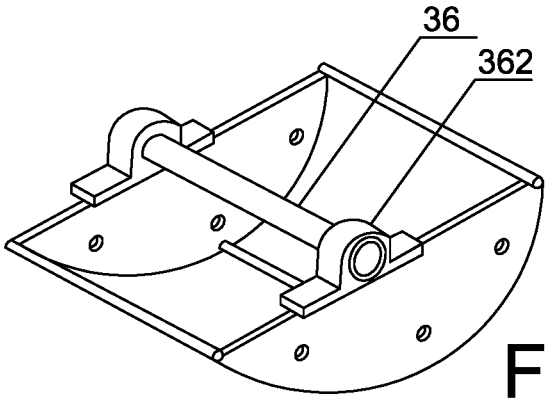
FIG. 9 represents a view of the slide which allows for forward-backward movement and rotation of the drilling bit.

A slide (35) is provided between the front and rear sides of the drilling machine body (34). The slide (35) moves among the drill chuck rotating shaft (361), slide forwarding shaft (351) and slide shaft (56). FIG. 9 represents a view of the slide (35).

Forward movement of the slide (35) is repeated in order to further drive the drilling bit (33) inside the formation. When the movement is repeated, the slide (35) moves forward, and then the magnetic drill chuck (36) releases the drilling bit (33), the slide (35) moves backward, the drill chuck (36) tightens the drilling bit (33) again, and the slide (35) forwards again. The preceding process needs to be repeated reversely in order to pull the drilling bit (33) out from the formation.

Figure 11:
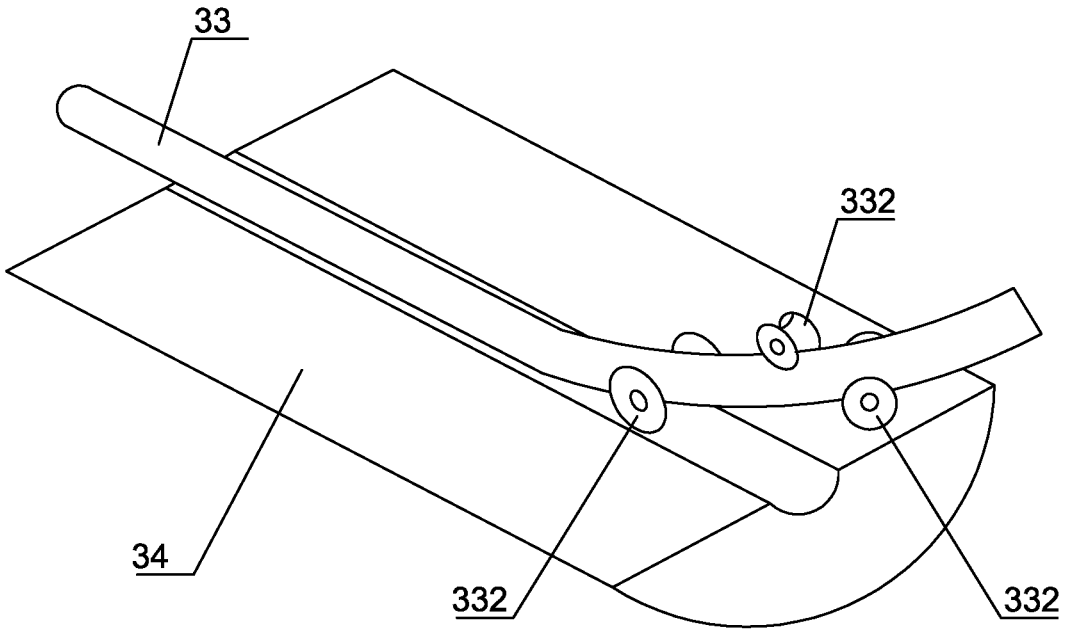
FIG. 11 represents a view of the drilling bit.

FIG. 11 represents a view of the drilling bit (33) inside the drilling machine body (34). As seen in the FIGURE, guiding rollers (332) are provided. The drilling bit (33) is guided into the formation by means of the guiding rollers (332).

FIG. 12 represents an upper plan view of drilled holes (5) into formation at targeted level and dissociated void spaces around holes (5). The stripped production tubing (4) is depressurized causing a region of low pressure spread through the holes (5) drilled into formation. Low pressure causes the formation to dissociate and release gas and water. As produced gas reaches the wellhead and free water flushes into the well, holes (5) expand and void spaces are created around the holes (5) initiating a cavern (6).

FIG. 13 represents a view of holes (5) drilled into formation at targeted level and a cavern (6) formed at targeted level. As controlling water level and water pressure inside the stripped production tubing (4) continued and controlling the amount of the produced gas from wellhead continued, low pressure at the targeted level is maintained. Low pressure causes the formation to further dissociate and to further release gas and water. It may be necessary to inject chemicals into the water jet and spray it into the void spaces around holes (5) by drilling bit (33) for inhibition of refreezing. Thus void spaces, which were already created around holes (5), expand and form a cavern (6) in the formation at targeted level.

FIG. 14 represents a view of holes (5) drilled into formation level at upper level and cavern (6) is expanded upwards.

The method developed to obtain gas from gas hydrate formation comprises basically the following process steps:

a. drilling a well containing gas hydrate formations,
b. placing a stripped production tubing (4) with plugs (41) alongside the gas hydrate formation into the drilled well,
c. selecting a lower elevation of the gas hydrate formation as targeted level,
d. removing water from the well providing depressurization of the stripped production tubing (4),
e. bringing a drilling machine (3) to the targeted level of the gas hydrate formation through the stripped production tubing (4) by means of a drilling machine lowering and controlling equipment (1),
f. drilling plugs (41) on the stripped production tubing (4) at the targeted level of the gas hydrate formation by means of drilling bit (33) of said drilling machine (3),
g. drilling holes (5) into the gas hydrate formation by means of the drilling bit (33) and allowing for dissociation of the formation to gas and water with diffusing low pressure into the formation through drilled holes (5),
h. controlling water level and water pressure inside the stripped production tubing (4) and the amount of the produced gas from wellhead to maintain a low pressure at the targeted level while dissociated gas and water is being replaced with a cavern (6), i. drawing said drilling bit (33) back into the stripped production tubing (4), j. repeating the process steps e, f, g, h and i at each level, starting from lower level to upper level of the gas hydrate formation, k. obtaining the separated gas from the wellhead.

A well is drilled with conventional methods into the gas hydrate formations under the frozen layers of earth (permafrost) in the cold regions or sea floor/slopes. The well profile may be vertical or sloped depending on the shape of the gas hydrate formation. Or bent from vertical position to horizontal position with a certain radius.

Depressurization of stripped production tubing (4) is provided by removing water from the well at the beginning. But later dissociated water from drilled holes (5) flushes into well. If not removed, pressure increases at the targeted level. Pressure at targeted level becomes sum of height of the water column in stripped production tubing (4) above targeted level and gas pressure. So water removal is required during gas production for depressurization of targeted level. For elimination of the water removal from stripped production tubing (4) during gas production, alternatively well is drilled deep enough to store the dissociated water coming from first level and if used water volume of water jet.

Afterwards, the stripped production tubing (4) is lowered into the well. Said stripped production tubing (4) is used preferably only along the gas hydrate formation. In such cases, conventional production tubing (2) is used from the top level of the gas hydrate formation reaching the wellhead. The drilling machine lowering and controlling equipment (1) is mounted to the wellhead valves. At this step, the drilling machine (3) is located inside the drilling machine loading pipe (12) and all cables and hoses are connected to the drilling machine (3) and all are wound to the drum of drilling machine lowering and controlling equipment (1).

According to methodology, it is preferred to start gas production from lower elevations of gas hydrate formation and continue to upper elevations to avoid continuous water removal during gas production. A lower elevation of the gas hydrate formation is selected as targeted level.

The drilling machine (3) is lowered to targeted level through the production tubing (2) and then the stripped production tubing (4) by drilling machine lowering and controlling equipment (1). The stabilizer legs (31) allow the drilling machine (3) to move inside the production tubing (2) and the stripped production tubing (4) without getting caught.

The sensor (37) on the drilling machine (3), which is now at the targeted level, detects the colored plugs (41) on the stripped production tubing (4) and the drill bit (3) is positioned.

Subsequently, the drilling bit (33) drills the plug (41) and reaches the formation. The drilling bit (33) reaching the formation forms a hole (5) in the formation. Alternatively hole (5) drilled with a slope for better draining of dissociated water from formation. Then, the drilling bit (33) is pulled back into the drilling bit casing (331) thus diffusing low pressure into the formation through drilled holes (5).

Drilling the plugs (41) and drilling holes (5) into formation continue during dissociation of the targeted level. More than one hole (5) may be drilled using same strip on the stripped production tubing (4) where drill bit (33) is guided to different directions by means of the guiding rollers (332).

Allowing for dissociation of the formation to gas and water. Dissociated water flushes down into the well through drilled hole (5) and produced gas reaches the wellhead. But, hydrate dissociation is an endothermic process, which is a process that uses heat. So, a natural consequence of dissociation is cooling and potential re-freezing of adjacent portions of the reservoir. Even if hot water is used for water jet drilling, it may become necessary to inject chemicals into the water jet and spray it into the dissociated void spaces around holes (5) by drilling bit (33) for inhibition of re-freezing.

At the same time controlling the amount of the produced gas from wellhead to maintain a low pressure at the targeted level. Gas production continues as long as pressure at the targeted level is lower than dissociation pressure of the formation and potential re-freezing of hydrate is overcome by hot water and/or chemical inhibition. It is necessary to avoid sudden decrease in the produced gas pressure since the potential for phase transition from the solid hydrate to release water and gas at a high rate when the pressure is reduced. Gas pressure in closed systems is a function of gas volume. This enables gas pressure is controlled by controlling amount of the gas taken out from wellhead.

Pressure at targeted level is sum of gas pressure and water pressure where water pressure is a function of height of the water column above targeted level. Pressure at targeted level is measured by means of pressure sensor and water level is measured by means of level sensor on the drilling machine (3) and gas pressure is measured at wellhead. Comparison of gas and water pressure and water level enables to understand conditions at targeted level. For example; If pressure at targeted level measured high, it means either water pressure or gas pressure is high. Then it is necessary to look at water level. If water level is low it means that gas pressure at targeted level is high. So produced gas volume at wellhead is adjusted to respond high gas pressure case. Pressure control and subsequent controlled removal of produced gas from wellhead enables low pressure is maintained at targeted level and sudden decrease or increase in the gas pressure is avoided as explained above. In extreme cases, if required, water inside the stripped production tubing (4) is discharged by means of pump or water let into the well.

Bringing the drilling machine (3) to one above level, which is new targeted level in the stripped production tubing (4) by means of the drilling machine lowering and controlling equipment (1).

Once a cavern (6) is formed next step is expanding the cavern (6) upwards. Distance between two levels is so selected that upper level is connected to cavern (6) after a while during dissociation. This provides water dissociated at upper level is filled into cavern (6) forming a dissociated water pool in the cavern (6).

Amount of produced gas provides an opinion about the size of the cavern (6) and depth of the drilled holes (5) helps to estimate height of the cavern (6). While selecting the distance between two levels, it is aimed to connect void spaces created around holes (5) to cavern (6) during dissociation of the upper level so that the distance is selected according to the height of the cavern (6).

The observed density of gas hydrate is around 0.9 g/cm$^3$, which means that gas hydrate floats to the surface of water and gas continue to dissolve from partially dissociated formation. Dissociated water pool, having much more surface area when compared with inside diameter of stripped production tubing (4), provides more opportunity for partially dissociated gas hydrate dissolving more gas. Chemicals used for inhibition of re-freezing of the dissociated void spaces around holes (5) at upper levels also drain into the dissociated water pool in the cavern and inhibition continues in the water pool.

Dissociated water pool also eliminates pumping need for dissociated water and partially dissociated gas hydrate to ground level and dissolving gas from dissociated water at ground level.

Such replacement of dissociated formation at upper level with dissociated water at lower level have also advantageous, like stabilization of the formation and elimination of water removal during gas production.

According to methodology, it is preferred to start gas production from lower elevations of gas hydrate formation and continue to upper elevations to avoid continuous water removal during gas production. Strips on the stripped production tubing (4) at the upper levels remain sealed to avoid uncontrolled dissociation around stripped production tubing (4), thanks to the plugs (41).

If plugs were not exist, low pressure diffuses to all levels of gas hydrate formation when stripped production tubing (4) is depressurized and formation starts dissociation around the stripped production tubing (4). When gas hydrate dissociates, almost 80% of the dissociated volume becomes water and flushes into well and fills in lower levels of the well. More dissociated water flushing into well increases the water level and so pressure at the lower level increases and dissociation at lower levels stops. Even if it is possible that dissociated water is removed from the well, hydrate dissociation is an endothermic process which is a process that uses heat. So, a natural consequence of dissociation is cooling and potential re-freezing of adjacent portions of the reservoir when temperature goes below the temperature at the dissociation pressure. So dissociation at all levels slows down and eventually stops after a while in the well causing limited adjacent portions of stripped production tubing (4) dissociated. So that gas production remains limited.

Elimination of this problem comes with level by level dissociation of the formation. According to methodology dissociated water is stored in the cavern (6) formed at the lower level of the well and potential re-freezing of the hydrate is overcome by chemical inhibition and heating of the formation by hot water jet, if used, level by level.

When drilling machine (3) is moved to a new level for removing the plugs (41) and drilling holes (5) into formation, the new level exposes to low pressure and starts dissociate.

All of the plugs (41) and holes (5) are drilled in level by level throughout the stripped production tubing (4). Gas is produced from the formation reaches the surface through the production tubings (2,4) and water remains inside the formation.

Afterwards, the drilling machine (3) is pulled back into the drilling machine loading pipe (12).

The invention claimed is:

1. A method for obtaining gas from gas hydrate formations under frozen layers of earth in cold regions or sea floor/slopes, comprising the steps of;

a. drilling a well containing gas hydrate formations, b. placing a stripped production tubing (4) with plugs (41) alongside the gas hydrate formation into the drilled well, c. selecting a lower elevation of the gas hydrate formation as a targeted level, d. removing water from the well providing depressurization of the stripped production tubing (4), e. lowering a drilling machine (3) to the targeted level of the gas hydrate formation through the stripped production tubing (4) by means of a drilling machine lowering and controlling equipment (1), f. drilling only through the plugs (41) on the stripped production tubing (4) that are located in the targeted level of the gas hydrate formation by means of a drilling bit (33) of the drilling machine (3) without drilling through a wall of the stripped production tubing surrounding the plugs, g. drilling holes (5) into the gas hydrate formation by means of the drilling bit (33) and allowing for dissociation of the formation to gas and water with diffusing low pressure into the formation, providing the depressurization only at the targeted level, through the drilled holes (5), h. controlling water level and water pressure inside the stripped production tubing (4) and the amount of the produced gas from a wellhead to maintain a low pressure at the targeted level while dissociated gas and water is being replaced with a cavern (6), i. pulling the drilling bit (33) back into the stripped production tubing (4), j. having a plurality of targeted levels and repeating the process steps e, f, g, h and i at each of the plurality of targeted levels, starting from a lower level to an upper level of the gas hydrate formation, k. and obtaining the separated gas from the wellhead.

2. The method according to claim 1, wherein following the process step (e), the drilling bit (33) on the drilling machine (3) is positioned by the plugs (41) on the stripped production tubing (4) by means of a sensor (37).

3. The method according to claim 1, wherein the drilled holes (5) inside the formation in step (g) are made by means of a water jet using the drilling bit (33).

4. The method according to claim 3, wherein water of the water jet is heated in a drilling bit casing (331) in the well.

5. The method according to claim 1, wherein the well drilled into the gas hydrate formations is deep enough to store the dissociated water coming from at least a first dissociated level.

6. The method according to claim 3, further comprising the step of injecting chemicals into the water jet and spraying the chemicals onto adjacent portions of the formation for inhibition of re-freezing.

7. The method according to claim 1, wherein an initial targeted level of the targeted levels is a lowest elevation of the gas hydrate formations.

8. The method according to claim 1, wherein the plugs are colored plugs.

9. The method according to claim 8, wherein a sensor is positioned on the drilling machine and the sensor detects the colored plugs.

* * * * *